United States Patent [19]

Hochgesang

[11] Patent Number: 4,531,793

[45] Date of Patent: Jul. 30, 1985

[54] MULTIPOLE EDGE STRIP CONNECTOR

[75] Inventor: Gerhard Hochgesang, Bad Neustadt, Fed. Rep. of Germany

[73] Assignee: Preh Elektrofeinmechanische Werke Jakob Preh Nach. GmbH & Co., Bad Neustadt, Fed. Rep. of Germany

[21] Appl. No.: 557,652

[22] Filed: Dec. 2, 1983

[30] Foreign Application Priority Data

Dec. 9, 1982 [DE] Fed. Rep. of Germany ..... 3245521

[51] Int. Cl.[3] ..... H01R 23/66

[52] U.S. Cl. ..... 339/17 F; 339/258 R

[58] Field of Search ..... 339/17 F, 176 MF, 176 MP, 339/258 R, 258 P

[56] References Cited

U.S. PATENT DOCUMENTS

| | | | |
|---|---|---|---|
| 3,336,565 | 8/1967 | Crimmins | 339/107 |
| 3,594,684 | 7/1971 | Miller | 339/258 R |
| 3,617,992 | 11/1971 | Ruehlemann et al. | 339/242 |
| 3,953,102 | 4/1976 | Rivetta et al. | 339/258 R |
| 4,019,798 | 4/1977 | Zielinski | 339/17 F |
| 4,111,510 | 9/1978 | Zurcher | 339/176 MF |
| 4,379,608 | 4/1983 | Olsson et al. | 339/176 MP |
| 4,401,356 | 8/1983 | Bare | 339/17 F |

FOREIGN PATENT DOCUMENTS

| | | |
|---|---|---|
| 0006725 | 1/1980 | European Pat. Off. . |
| 0026568 | 4/1981 | European Pat. Off. . |
| 1765092 | 11/1971 | Fed. Rep. of Germany . |
| 1920988 | 3/1977 | Fed. Rep. of Germany . |
| 1079851 | 8/1967 | United Kingdom . |

*Primary Examiner*—Neil Abrams

*Attorney, Agent, or Firm*—Woodcock Washburn Kurtz Mackiewicz & Norris

[57] ABSTRACT

A multipole edge connector for the electrical connection of strip contact surfaces of a flexible flat ribbon cable with the congruent edge contact surfaces of a printed circuit board having the same modular dimensions. The edge connector consists of a clamp-like holder which is fastened with holding means in the form of barbs on the edge of the printed circuit board, and which has a plurality of flexible tongues. To permit the preparation of the holder at low cost, it comprises two members which are cut off from two different metal strips with pre-punched and pre-embossed profiles, which members are joined together by welding in a perforated zone. The members are profiled to provide a cross section with a half-tulip-shaped, asymmetric clamping contour, whereby each of the flexible tongues provides a uniform contact pressure.

18 Claims, 4 Drawing Figures

Fig. 2
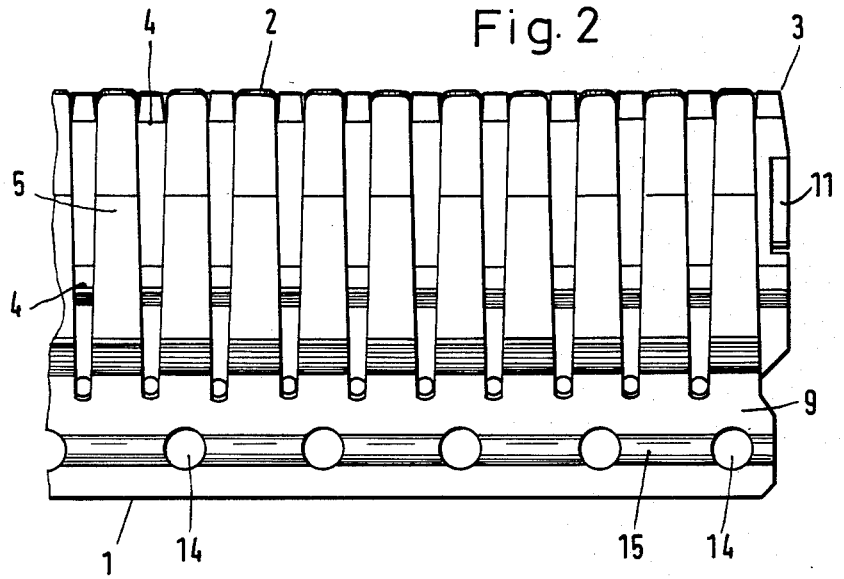
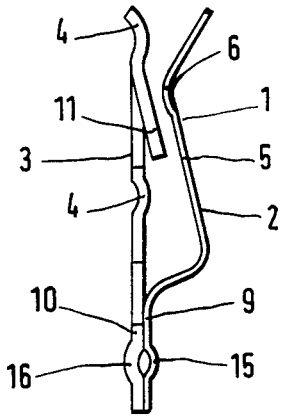
Fig. 3

MULTIPOLE EDGE STRIP CONNECTOR

BACKGROUND OF THE INVENTION

This invention relates to connector apparatus for connecting a flat ribbon cable to a printed circuit board or other like circuit device, and in particular multiple edge connector strip apparatus adapted to clamp a ribbon cable to a printed circuit board.

Flexible flat ribbon cables are being increasingly used at present in electronics because of their easy applicability and their reduced space requirement. The connection of such cables with other electronic units, especially printed circuit boards, has been provided to date by soldering, crimping, pressing or similar means, or via specific plug-in connections. These processes and devices usually serve their purpose satisfactorily, but are often expensive and usually not reliable enough. There is an inherent difficulty in making a reliable connection, specifically in the case of the plug-in connections, due to the flexibility of the flat ribbon cable.

A device for the detachable connection of a flexible flat ribbon cable with a printed circuit board is already known from West German Pat. No. 19 20 988. This patent discloses a wedge-shaped clamping means around which a flexible flat ribbon cable with strip conductors non-isolated from the outside is laid, and is fastened by a clamping frame. The strip conductors of the printed circuit board are spanned by a plastic clamping saddle which is inserted with its ends into matching openings of the printed circuit board by means of a snap-in connection. The clamping means with the flexible flat ribbon cable is pushed into the opening between the clamping saddle and the printed circuit board and pressed far enough to achieve force fit, and the strip conductors of the flat ribbon cable contact the congruent strip conductors or contact surfaces of the printed circuit board. This detachable connection can be arranged either at the edge or on the inner surface of the printed circuit board, but is not attachable around an edge of the printed circuit board.

Another connector is described in European Pat. No. 0,006,725, which serves the purpose of providing an electrical connection between the strip condutors of a flexible flat ribbon cable and those of a printed circuit board. To achieve this there is provided a clamp-like metal holder which has laterally projecting tabs which are bent over after being introduced into openings in the printed circuit board. Even though the cable is detachable, the holder cannot be removed often from the printed circuit board because the tabs break off upon repeated bending in alternate directions. The contact pressure is brought about by a plurality of flexible tongues which press the opposite strip conductors against one another. Since the flexible tongues are cut out as one piece together with the metal holder, the flexible flat ribbon cable or any strip conductors or contact surfaces on the side on which the flexible tongues lie, must be isolated to avoid short circuit.

Another similar connector assembly is described in European patent application No. 0,026,568. The clamp-like holder, being very long, has several projecting tabs spaced over its length for holding onto the printed circuit board. This is necessary to achieve as uniform a contact pressure as possible for all of the flexible tongues. There is also a lifting device which makes it possible to eliminate or reduce the contact pressure by lifting the flexible tongues, so that the flexible flat ribbon cable can first be laid into the holder without applying force, and can be pressed only thereafter by using the device.

SUMMARY OF THE INVENTION

It is an object of this invention to create a multipole strip connector having a plurality of flexible tongues for applying uniform contact pressure, which connector can be prepared in a simple and inexpensive manner.

It is another object of this invention to provide an edge connector for providing a reliable connection between multiple terminal strips on a printed circuit board or like system and a multiple lead connector dimensioned to register with the terminal strips of the printed circuit board which provides increased reliability and ease of attachment.

It is another object of this invention to provide a multipole strip connector adapted to provide uniform contact pressure between a plurality of leads on a printed circuit board or like circuit and a multiple lead cable such as a flexible flat ribbon cable, which connector can be reliably placed into and removed from its connecting position easily and repeatedly.

In accordance with the above objects, there is provided a multipole edge connector for the electrical connection of a plurality of contact surfaces of a flexible flat ribbon cable with the congruent or corresponding edge contact surfaces of a printed circuit board having the same modular dimensions, e.g., equal spacings between conductor strips. The edge connector comprises a clamp-like holder means for clamping the ribbon over an edge of a printed circuit board, the holder or holder means having a plurality of flexible tongues for providing uniform contact pressure of the ribbon conductor strips against the circuit board conductor strips. The holder comprises two members which are cut preferably from different metal strips with pre-punched and pre-embossed profiles, and which are joined together by welding in a perforated holding zone, thereby permitting the preparation of the connector at a low cost. The holding members are profiled or contoured so as to provide an asymmetric clamping contour cross section.

Due to the holder initially being bipartate, the two parts can be optimally adapted to their required functions. The immovable supporting part may consist, for example, of a stronger material of greater thickness. Greater counterpressure can thus be generated, as is necessary in the case of a long edge connector strip. The degree of contact pressure may be varied within certain limits by selecting the thickness of the metal strip of which the flexible tongues consist. Further, the connection by roll welding of the two members with one another permits simple preparation of the members from bands of sheet metal. Depending upon where the band is cut by means of a cutting device, holders of different dimensions may be obtained.

BRIEF DESCRIPTION OF THE DRAWINGS

The present invention will be described below in greater detail with respect to two examples illustrated in the following figures:

FIG. 2 shows a top view of the multipole edge connector of FIG. 1;

FIG. 3 shows a section through the edge connector of FIG. 1; and

DESCRIPTION OF THE PREFERRED EMBODIMENTS

Figure 1:
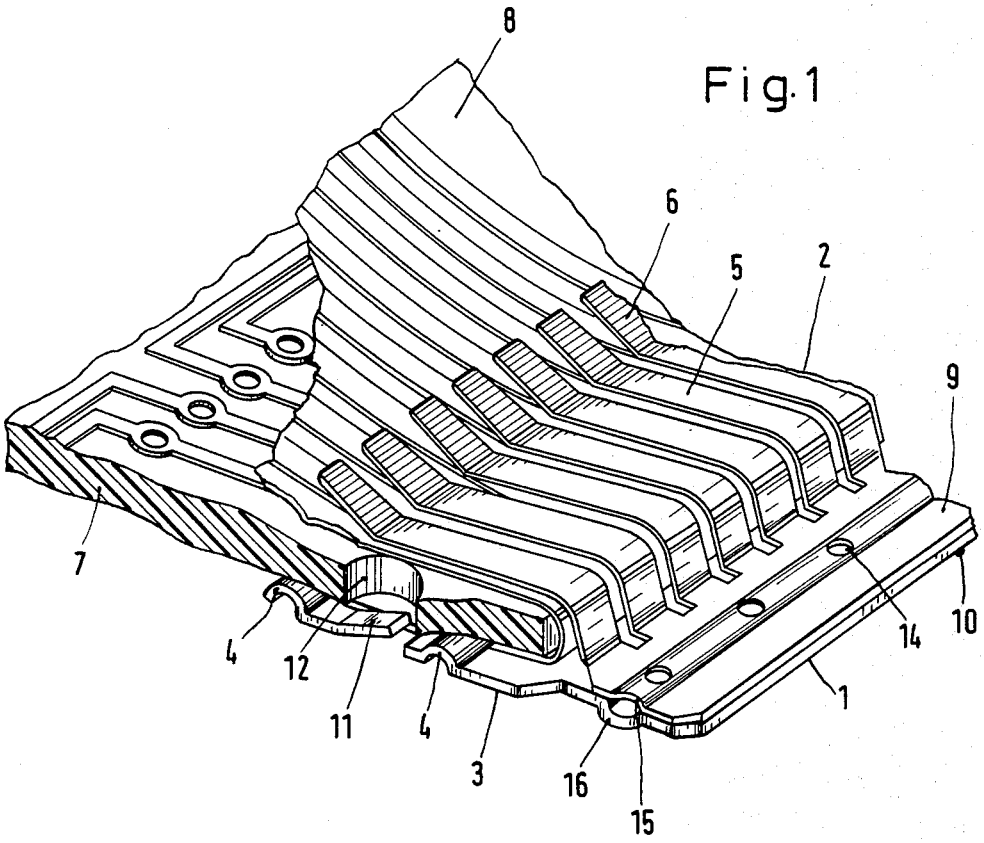
FIG. 1 shows an exploded top view of an edge connector pushed over a printed circuit board.

Referring to FIG. 1, a printed circuit board is designated by 7, in which electronic components (not shown) are arranged on a substrate, which components are connected with one another by strip conductors. As is common, part of certain strip conductors are led to the edge of the printed circuit board. The electrical connection with the remainder of the electronic units or circuits which interact with the printed circuit board in question is ensured by means of a flexible flat ribbon cable 8 instead of individual wires, the ribbon being in the form of a transparent film on which strip conductors are likewise applied on one side in such a way that they face the strip conductors of the printed circuit board. The strip conductors of the flat ribbon cable are visible in FIGS. 1 and 4, even though they are on the back side, because the film is transparent. The strip conductors of both the printed circuit board and of the flexible flat ribbon cable are congruent with one another, i.e., register with one another, and are arranged in the same modular dimension; the width of the strip conductors of the printed circuit board is smaller to equalize tolerances in coverage. The arrangement is, of course, such that no short-circuits can occur. As seen in FIG. 1, the electrical connection of the strip conductors is achieved by a clamp-like holder 1 which is pushed over the printed circuit board, and which presses the corresponding strip conductors against one another. The end of the flexible flat ribbon cable is bent over the edge of the printed circuit board in an arc shape to avoid buckling. A corresponding space is provided between the holder and the edge of the printed circuit board, which space results from the profile of the upper protion of member 2.

Referring particularly to FIGS. 2 and 3, the holder 1 consists of two members 2, 3, of approximately equal length, where length refers to the distance across the front where the two members are joined. Each of these two members is suitably prepared from a different metal strip. The metal strips differ from one another in the two embodiments shown in the figures only in thickness. It is also within the scope of the invention, in adaptation to the function of the members, to use different materials and different thicknesses. In preparation, the metal strips are pulled off from a supply roll, and then punched, bent and embossed one by one corresponding to the intended use. The two members are then brought together and fixedly joined by spot welding or preferably roll welding. The holder is finally cut to the desired length. This cutting operation is carried out in two steps. The two holding strip portions 9, 10, which are welded together in the final form, are first cut at the desired point by means of an upper die. The flexible tongues which are not needed are dropped off as part of this operation. The second member is then cut off, and the barbs 11 are cut free and bent at the same time.

As is apparent from FIG. 3, the second member is prepared from a metal strip of a greater thickness. This member is therefore relatively more rigid than the first member which is prepared from a metal strip of smaller thickness. To additionally increase the rigidity of the second, or lower member, the second member 3 possesses two linear embossings 4 which run substantially the length of the member. In addition, two barbs 11 are cut free and bent out of the plane by a small angle at both sides of the member 3, which barbs are positioned to engage openings 12 in the printed circuit board 7 to ensure catching and proper registration, i.e., the holder clamps over a predetermined edge portion of the printed circuit board corresponding to the board contact surfaces which are to be connected. Perforations 14, which serve to facilitate manual transport, are cut approximately in the middle of the holding strip portion 10, spaced equally from one another. In the zone of the perforations the holding strip has a longitudinal groove 16.

This longitudinal groove 16 serves to reinforce the member, and also provides a sort of handle for use when one wishes to pull the holder off from its anchorings on the printed circuit board after releasing the barbs. The spot welding or roll welding is carried out on both sides of the longitudinal groove 16, providing means of integrally welding the two holding strip portions.

The first upper member also has a longitudinal groove 15 in the holding strip 9, arranged opposite to groove 16 in such a way that the two grooves are arched outwardly in opposite directions. The first member 2 also has perforations whose locations coincide with those of the second member. The holding strip 9 comprises the flexible tongues 5 which have been cut free, each of which tongues consists of a bulged middle part and of an end part 6 bent at a predetermined angle. As is clearly apparent from FIG. 3, the two members present a half-tulip-shaped, asymmetrical clamping contour in cross section when welded together. As used herein, the term "half-tulip-shaped" refers to a form substantially as illustrated in FIG. 3. When free, i.e., when not clamped to the board 7, the separation of the part 6 from the second member 3 is less than the thickness of board 7, as illustrated.

When the holder is pushed to the edge of the printed circuit board, the end part 6 of each of the flexible tongues presses the strip conductors against each other. The immovable supporting part of member 3 which absorbs the pressure of the tongue end parts is defined by the two embossings 4, and the end part 6 is located between the two embossings. The embossings 4 are separated by a predetermined distance so as to define a pressure portion which absorbs pressure from tongues 6, which tongues are positioned approximately midway between the embossings. A three-point bearing is thus achieved, which permits exact and sure contact, because the holder cannot shake. Since the flexible tongues exert only a mechanical rather than an electrical function, no precious-metal plating is needed.

Figure 4:
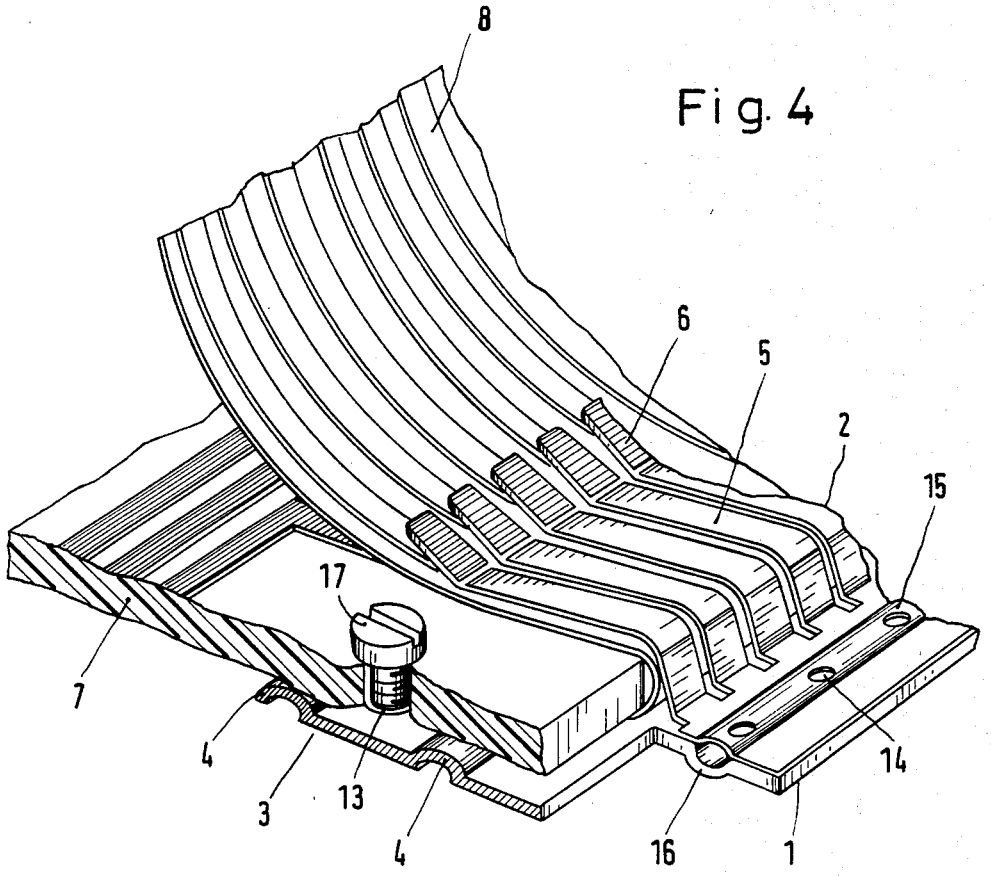
FIG. 4 shows an exploded top view of another multipole edge connector embodiment of this invention.

An embodiment of a holder, in which the two members are of equal length, is shown in the FIGS. 1 through 3. FIG. 4 shows in contrast an alternate embodiment in which the two members are of different length, i.e., the second member 3 is longer than the first member 2. This is easy to achieve, because the cutting is performed in two steps with different cutting dies. The tongued strip or member 2 is cut first here, too. The flexible tongues cut free over this length now drop off. The second cutting is carried out according to the desired length of member 3 simultaneously with the preparation of a fastening hole 13. A corresponding hole is also provided in the printed circuit. Together with the holder the printed circuit can be fastened by means of this fastening hole for example, on a chassis using a screw 17.

The cutting of the holder into two members also makes it possible to bend the flexible tongues over during preparation, so that the distance between the end part 6 of each flexible tongue of the first member to the embossings of the second member can be kept very small. It is thus possible to use a second flat ribbon cable instead of the printed circuit board, so that the strip conductors of two flat ribbon cables are pressed against one another and connected electrically with one another. Accordingly, as used in the claims of this invention, the term printed circuit board may embrace a ribbon or the like which carries a plurality of strip type contact surfaces.

I claim:

1. Multipole edge connector apparatus for the electrical connection of contact surfaces of a flexible flat ribbon cable with the congruent edge contact surfaces having the same modular dimensions of a printed circuit board, comprising:

clamplike holder means for holding said cable contact surfaces and said printed circuit board contact surfaces in predetermined connection, said holder having first and second members whereby the holder can be attached to an edge of said printed circuit board, said first and second members having respective holding strip portions and being attached at said portion, said first and second members having respective different thicknesses and having profiles which provide an asymmetric clamping contour, said first member having a smaller thickness that said second member and comprising flexible tongues corresponding to each of the congruent contact surfaces, each of said tongues having an end part contoured to apply pressure against said cable and circuit board contact surfaces, said second member having a supporting part of greater thickness than said first member and having embossed means for defining a pressure portion thereof which absorbs pressure from said tongue end parts, and wherein said holding strip portions each have opposing longitudinal grooves, and comprising weld fixing means integrally joining said holding strip portions on both sides of said grooves.

2. The connector apparatus as described in claim 1, wherein said holder means further comprises mounting means for mounting said holder means so that it clamps over a predetermined edge portion of said printed circuit board.

3. The apparatus as described in claim 1, wherein said asymmetric clamping contour is substantially half-tulip-shaped.

4. The multipole edge connector strip as described in claim 1, characterized in that said embossing means comprises two linear embossings spaced a predetermined distance from each other, and wherein said end parts of said flexible tongues register substantially midway between said embossings.

5. The connector apparatus as described in claim 1, characterized in that said mounting means comprises an inwardly directed barb at each side of the length of said holder means, and said printed circuit board comprises openings which register with said barbs, whereby each said barb reaches into one of said openings to prevent unintended pulling off of said holder means from said printed circuit board edge.

6. The connector apparatus as described in claim 1, characterized in that each of said two members is approximately of the same length.

7. The connector apparatus as described in claim 1, characterized in that said two members have different lengths, the longer of said members comprising a fastening hole.

8. The connector apparatus as described in claim 1, wherein said tongue end parts are normally separated from said pressure portion by a predetermined distance which is smaller than the thickness of said printed circuit board, whereby when said clamp-likeholder means is attached over the edge of said printed circuit board a contact pressure is applied by said tongues to hold said ribbon cable contact surfaces in reliable mechanical contact with said printed circuit board contact surfaces.

9. The apparatus as described in claim 1, wherein said asymmetric clamping contour is substantially half-tulip-shaped.

10. The connector apparatus as described in claim 1, characterized in that said embossing means comprises two linear embossings spaced a predetermined distance from each other, and wherein said end parts of said flexible tongues register substantially midway between said embossings.

11. The connector apparatus as described in claim 3, characterized in that said embossing means comprises two linear embossings spaced a predetermined distance from each other, and wherein said end parts of said flexible tongues register substantially midway between said embossings.

12. The connector apparatus as described in claim 2, characterized in that said mounting means comprises an inwardly directed barb at each side of the length of said holder means, and said printed circuit board comprises openings which register with said barbs, whereby each said barb reaches into one of said openings to prevent unintended pulling off of said holder means from said printed circuit board edge.

13. The connector apparatus as described in claim 1, characterized in that said mounting means comprises an inwardly directed barb at each side of the length of said holder means, and said printed circuit board comprises openings which register with said barbs, whereby each said barb reaches into one of said openings to prevent unintended pulling off of said holder means from said printed circuit board edge.

14. The connector apparatus as described in claim 3, characterized in that said mounting means comprises an inwardly directed barb at each side of the length of said holder means, and said printed circuit board comprises openings which register with said barbs, whereby each said barb reaches into one of said openings to prevent unintended pulling off of said holder means from said printed circuit board edge.

15. The connector apparatus as described in claim 4, characterized in that said mounting means comprises an inwardly directed barb at each side of the length of said holder means, and said printed circuit board comprises openings which register with said barbs, whereby each said barb reaches into one of said openings to prevent unintended pulling off of said holder means from said printed circuit board edge.

16. The connector apparatus as described in claim 4, characterized in that each of said two members is approximately of the same length.

17. The connector apparatus as described in claim 4, characterized in that said two members have different lengths, the longer of said members comprising a fastening hole.

18. The connector apparatus as described in claim 4, wherein said tongue end parts are normally separated from said pressure portion by a predetermined distance which is smaller than the thickness of said printed circuit board, whereby when said clamp-likeholder means is attached over the edge of said printed circuit board a contact pressure is applied by said tongues to hold said ribbon cable contact surfaces in reliable mechanical contact with said printed circuit board contact surfaces.

* * * * *

UNITED STATES PATENT AND TRADEMARK OFFICE

CERTIFICATE OF CORRECTION

PATENT NO. : 4,531,793

DATED : July 30, 1985

INVENTOR(S) : Gerhard Hochgesang

It is certified that error appears in the above-identified patent and that said Letters Patent is hereby corrected as shown below:

In Claim 1, Column 5, Line 27, "portion" should read --portions--.

Signed and Sealed this

*First* Day of *October 1985*

[SEAL]

*Attest:*

DONALD J. QUIGG

*Attesting Officer*

*Commissioner of Patents and Trademarks—Designate*